US005560228A

United States Patent [19]

Lukic

[11] Patent Number: 5,560,228

[45] Date of Patent: Oct. 1, 1996

[54] TEXTILE MACHINE

[75] Inventor: Boris Lukic, Zdenici, Croatia

[73] Assignee: Universal Maschinenfabrik Dr. Rudolf Schieber GmbH & Co. KG, Germany

[21] Appl. No.: 381,844

[22] PCT Filed: Aug. 10, 1993

[86] PCT No.: PCT/IT93/00089

§ 371 Date: Mar. 30, 1995

§ 102(e) Date: Mar. 30, 1995

[87] PCT Pub. No.: WO94/03668

PCT Pub. Date: Feb. 17, 1994

[30] Foreign Application Priority Data

Aug. 3, 1992 [DE] Germany ..... 42 25 655.0

[51] Int. Cl.[6] ..... D04B 15/78

[52] U.S. Cl. ..... 66/220; 66/219

[58] Field of Search ..... 66/216, 215, 218, 66/220, 221, 75.2, 232

[56] References Cited

U.S. PATENT DOCUMENTS 4,688,404 8/1987 Elsässer et al. ..... 66/219

5,205,139 4/1993 Aria ..... 66/219 X

FOREIGN PATENT DOCUMENTS 479371 4/1992 European Pat. Off. ..... 66/219

1547804 11/1968 France ..... 66/220

4024742 2/1992 Germany ..... 66/219

*Primary Examiner*—John J. Calvert

*Attorney, Agent, or Firm*—Limbach & Limbach L.L.P.

[57] ABSTRACT

In a textile machine, in particular in a knitting machine, with controllable working elements and an arrangement for selecting the working elements, the working elements are held in their initial position by a holding magnet and are selectively released from their initial position by an electromagnetic control system. In order to obtain a textile machine with a simple design, capable of being driven at high working speeds but in a reliable and safe manner, at least one holding magnet is rigidly fixed to the part of the textile machine that carries the working elements. A direct contact between the working elements and the moving control system is thus avoided, so that a contactless selection of the working elements is made possible.

21 Claims, 1 Drawing Sheet

TEXTILE MACHINE

DESCRIPTION

Textile machine, in particular a knitting machine, including controllable working elements and a working element selection device, wherein the working elements are held in their initial position by a holding magnet and are selectively released from their initial position by an electromagnetic control system.

BACKGROUND OF THE INVENTION

Textile machines of this type, in particular circular and flat bed knitting machines, are known for example from the DE 15 85 206 A2, DE 20 10 973 A2, DE 21 50 360 A1, DE 25 19 896 A1 and DE 36 14 220 A2. Arrangements of this type having controllable working elements and an electromagnetic control system are especially envisaged for the purpose of controlling patterns and as needle selection devices. Therein, the selection of a needle results from the direct effect upon the individual knitting elements, such as needles, sinkers, springs or the like, or, it is effected by controlling the ferromagnetic parts of the knitting elements indicated, whereby the electromagnetic control system moves relative to the knitting elements located in the needle channels, in a direction which is transverse to that in which the needles are driven-out. In order for the working elements to be got into the requisite initial position for the selection process, there are provided permanent magnets which—by virtue of the effect of cams, if need be—hold the working elements in their initial position for the selection process against the spring force of the take-off springs. Consequently, the permanent magnet, which is disposed in the movable control system, slides over the working elements. In order to reduce the high degree of friction arising thereby, a rail consisting of a material which is as smooth and hard as possible is placed between the poles and the working elements in order to minimise the frictional forces and the abrasion due to the friction. The permanent magnet thereby slides along, over the working elements, until the control system, including its selection system, arrives at the knitting element which it is intended to select. This selection region is as wide as the working element and is separated by a narrow gap from the poles of the permanent magnet so that the magnetic field of the permanent magnet can be neutralised in this region by means of a control coil. Consequently, the selected working element is drawn out by the selection system under the influence of the spring force of a take-off spring, while the other working elements continue to be held in position by the magnetic poles of the permanent magnet.

The magnetic flux in the working elements is dependent on the number of working elements which are respectively selected, or, which are still adhering to the selection system so that the electromagnetic force of attraction that is effective on the working elements also alters. The magnetic flux of the control coil, with which the permanent magnet is compensated in the selection region, also has to be altered in a corresponding manner. It is known from the DE 36 14 220 A2 to provide a Hall probe for measuring the instantaneous magnetic flux and to alter the current being admitted into the control coil of the electromagnet in dependence on the output signal of the Hall probe.

As already mentioned, in all of these conventional selection systems, there arises a considerable amount of friction between the working elements, perhaps the sinkers, and the control system sliding thereover and this friction has an adverse effect upon the reliability of the selection system and the whole manner of operation of the textile machine which becomes worse, the higher the speed of operation. Since the friction is dependent upon the force of attraction i.e. upon the density of the magnet field in the working element, as well as upon the dimensions of the contacting surfaces, one had to attach great importance to keeping the friction small by using as small a magnetic flux as possible in the conventional textile machines of this type. However, the consequence of this was that the working elements were not always held reliably in the selection system, or, that working elements, which were not deliberately selected, became detached from the selection system.

A further substantial disadvantage of conventional selection systems of this type consists in that there is only a short period of time available during which the selection region is magnetically neutral due to the small region in which the selection is carried out. In accordance with a proposal known from the DE-25 56 840 A1, a plurality of selection arrangements are arranged adjacent to one another in staggered manner in order to thereby achieve higher working speeds of the textile machine and more positive procedures for the selection of the working elements. However, this arrangement has the disadvantage that a lot of space is required and, in particular, that a large number of permanent magnets and control coils have to be used, which also substantially complicate machines of this type as regards their manufacture, installation and servicing and give rise to a greater susceptibility to failure.

A textile machine is known from the CH-A-479 738, in which a respective individual permanent magnet is provided for each needle or for each selection sinker, each of which permanent magnets is compensated in a controllable manner as regards its permanent-magnet-effect by means of an appropriate excitation coil in order to bring about the selection of the needles. A selection device of this type is very expensive due to the large number of individual excitation coils and the expense associated therewith for the respective control means and the cabling for the excitation coils. In addition, the biassing for the sinkers by means of springs and the components for the release and arresting of the sinkers is very complicated and expensive. Moreover, the temperature of the needle bed is raised due to the excitation of the coils, which are effectively in thermal contact therewith, which is something that is disadvantageous.

A textile machine is known from the WO-A-9 202 672, in which an electromagnetic control system is guided over a needle bed, wherein respective static intermediate elements consisting of ferromagnetic material are provided in the needle bed for each individual needle channel or for each needle or sinker, in an area that is basically not magnetically excitable, in order to conduct a magnetic flux through these intermediate elements to the needles or to the sinkers. The manufacture of a control system of this type or, of a needle bed of this type is expensive due to the static intermediate elements in the needle bed.

SUMMARY OF THE INVENTION

Consequently, the object of the invention is to develop a textile machine which does not exhibit the disadvantages of conventional textile machines, which has a simple construction, which can be driven at high working speeds and which nevertheless works reliably and safely.

The posed object is achieved in accordance with the invention in that the holding magnet is rigidly fixed to the part of the textile machine carrying the working elements.

Due to the measure in accordance with the invention of fixing the holding magnet to the part of the textile machine carrying the working elements, one achieves the end that a direct contact between the working elements and the moving control system is no longer required. As a result of this, it is possible to select the working elements in a non-contact making manner.

In accordance with an especially advantageous embodiment of the invention, the control system is movable in non-contact making manner over at least one external surface of the working elements. The control system, which may for example be a selection system, can thus move in non-contact making manner and hence likewise, in frictionless manner without exerting any mechanical effect, over the working elements.

The working elements are preferably manufactured from a ferromagnetic material.

In accordance with another advantageous embodiment of the invention, the control system comprises at least one controllable selection magnet which applies a controllable magnetic flux to at least one working element. The controllable selection magnet of the control system produces either a magnetic flux or no magnetic flux or an oppositely directed magnetic flux in the working element in accordance with the way it is controlled so that, in dependence thereon, the working element abutting the holding magnet in the initial position is held or released or is repelled.

It is especially advantageous if the working elements each comprise a spring element for biassing purposes. In each case, the spring elements are preferably formed in one piece with the working elements.

One advantageous embodiment of the invention consists in that the magnitude of the magnetic flux of the holding magnet is selected to be such that it holds the working elements in their initial position against the spring force of the spring element. It is thereby ensured that, the working elements are located in the initial position at the spot where it is intended they be selected by the control system or its selection magnet.

In this connection, it is advantageous if the selection magnet selectively produces a magnetic flux which is directed oppositely to the magnetic flux produced by the holding magnet. Thus, should a working element be selected, the magnetic flux of the holding magnet is reduced by the selection magnet of the control system, or it is substantially cancelled or is even oppositely directed, so that the working element can be moved from the initial position or the quiescent position by virtue perhaps, of the spring force. Due to the measure in accordance with the invention of providing the holding magnet on the part of the textile machine carrying the working elements, and not on the control system, the force of attraction, with which the working elements abut the intermediate elements and are placed in the initial position for the selection magnet, can be increased, without any qualms, in order to guarantee that the working elements are securely held in the initial position. Since, in contrast to the conventional arrangement, there is no movement, and hence no friction, on the working elements in accordance with the present invention, one can freely select the force of attraction of the magnetic flux which is produced by the holding magnet in the working elements. It is especially advantageous thereby, that any increase of the magnetic force of attraction exerted by the holding magnet makes it possible to enlarge the take-off spring force whereby the selection process is made more positive and reliable. In addition, due to the high take-off force which is now possible, there is an opportunity for a direct control of the knitting implements, of the knitting needles perhaps, without any additional auxiliary elements, such as selection sinkers, so that substantially simpler component groups thereby result.

It is envisaged, in accordance with a preferred embodiment of the invention, that, when selecting a working element, the selection magnet produce a magnetic flux which substantially corresponds in strength to the magnetic flux produced by the holding magnet but which is directed oppositely thereto. Thus, the selection of the working elements is effected by the selection magnet in such a way that the magnetic flux produced in the working element by the holding magnet is substantially cancelled or nullified by the magnetic flux produced by the selection magnet, or else, that it is at least reduced to an extent such that the spring force of the spring is greater than the magnetic drawing force. The working element which is to be selected can thereby be separated from the holding magnet due to the effect of a take-off spring force. Should, on the other hand, a certain working element not be selected, then the selection magnet is not excited so that the magnetic field produced in the working element by the holding magnet remains undisturbed and continues to hold the working element in its initial position.

It is advantageous if the selection magnet is an electromagnet including an excitation coil through which a controlled current flows. The magnetic flux of the selection magnet can be optimally controlled for the selection process in this manner.

An embodiment, in which, as regards their surface shape and dimensions, the pole faces of the selection magnet substantially correspond to the outer surfaces of the intermediate elements which face the control system, is especially advantageous. This embodiment too, makes it possible to have a good transition of the magnetic lines of force between the pole face of the selection magnet and the working elements with a very low stray flux. Thereby, the air gap between the control system, i.e. between the pole face of the selection magnet, and the outer surfaces of the working elements which face the control system should be as small as possible, although it has to be sufficiently large that the parts which are moved relative to one another do not touch.

A particularly advantageous embodiment of the invention consists in that the control system comprises at least two control regions which are spaced from one another in the direction of movement. It is thereby possible to further optimise the control arrangement, in particular of the selection magnets, namely, in that as seen in the direction of movement, control processes, which succeed one another in space and time, can be triggered-off without there being any relative disturbance due to the separation in space and time.

The features in accordance with the invention can be put to particular advantage when the textile machine is a circular or flat bed knitting machine.

The working elements are, in advantageous manner, actuating elements which are effective on the implements forming the stitches, for example, the needles. Sinkers for example, can be used as the actuating elements.

The working elements are preferably placed in their starting position by at least one control element, wherein, advantageously, the control element is a presser cam.

In accordance with a further advantageous embodiment of the invention, the pole faces of the selection magnet are guided in non-contact making manner past the end faces of the actuating elements which are remote from the needles. Thus, the selection magnets, which are located on the cams in the case of flat bed knitting machines, are guided past the lower, narrow surface of the needle bed. Preferably, the pole faces move in a region, which corresponds to the region of the outer edges of the actuating elements, when the actuating elements are located in the initial position.

In knitting machines, the holding magnet is preferably arranged below the needle bed and preferably extends in the form of a magnetic strip over the full length of the needle bed. In round knitting machines, this corresponds to the cylindrical periphery of the needle bed. As an alternative however, it is also possible to construct the magnetic strip from a plurality of individual magnetic elements.

The guidance means for the magnetic field from the holding magnet to the spot at which the working elements are intended to be held in their initial position may be formed from appropriate parts consisting of ferromagnetic material, preferably a yoke strip, wherein the pole face of the yoke is the holding surface for a corresponding holding part of the working element. One has a greater degree of freedom regarding the location of the holding magnet due to the use of yoke elements of this type.

In particular in connection with a flat bed knitting machine, the yoke is an L-shaped web consisting of ferromagnetic material which extends over the full length of the holding magnet.

BRIEF SUMMARY OF THE DRAWINGS

The invention will be described hereinafter with the help of an embodiment taken with reference to the drawings. Therein.

DESCRIPTION OF THE PREFERRED EMBODIMENT

Figure 1:
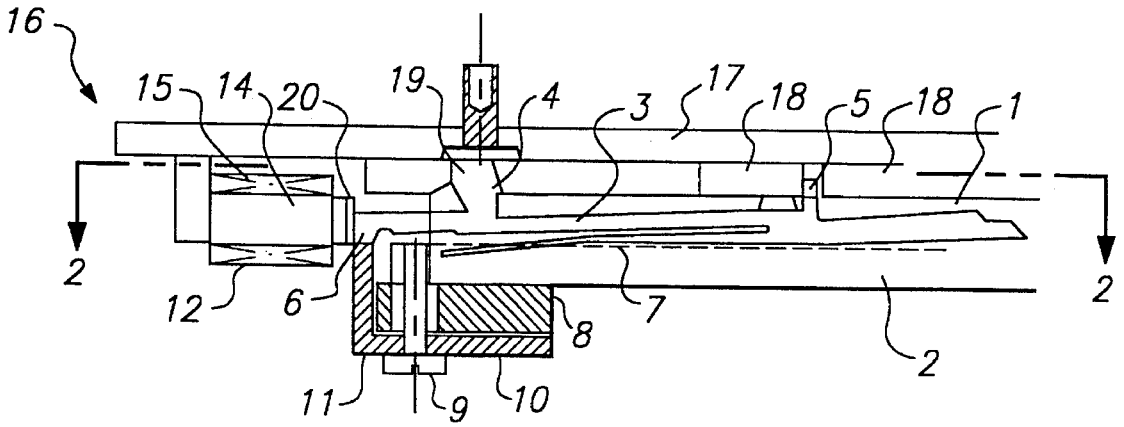
FIG. 1 shows the arrangement in accordance with the invention based on the example of a flat bed knitting machine, in the form of a schematic cross-sectional illustration.

A selection sinker 3 and a not-illustrated needle are located in each of the needle channels 1 of a needle bed 2 of a flat bed knitting machine. The selection sinker 3 comprises a sinker presser butt 4, a sinker control butt 5, a holding part 6 and a spring part 7. A holding magnet 8 is fixed to the needle bed 2, by means of bolts 9 for example, below the needle bed 2 in a region of the needle bed 2 which is remote from the needle bed comb. The holding magnet 8 extends, in the form of a permanent magnetic strip, over the full length of the needle bed 2 which comprises the needle channels 1. At the same time, an L-shaped yoke web 10 is fixed by means of the bolts 9 to the holding magnet 8, once more over the full length of the needle bed, such that the longer leg of the L-shaped yoke web 10 is located on the face of the holding magnet 8 which is remote from the needle bed 2. The short leg of the L-shaped yoke web 10 extends over a part of the lower, narrow side of the needle bed 2 up to the holding part 6 of the selection sinker 3. In the embodiment illustrated in FIG. 1, the selection sinker 3 is held magnetically on the front surface of the short leg of the L-shaped yoke web 10 against the spring force of the spring part 7 of the selection sinker 3.

Furthermore, the working element selection device comprises the control systems 12, 13 which each include a selection magnet 14 in the form of an electromagnet having at least one excitation coil 15. The control systems 12, 13 are part of a cam carriage 16, which comprises a cam plate 17 including the cams 18 for the control of the sinker control butt 5 as well as the presser cams 19 which press the presser butt 4 of the selection sinker 3 downwardly against the spring force of the spring part 7 so that the holding part 6 of the selection sinker 3 touches the oppositely located front face of the short leg 11 of the L-shaped yoke web 10, or, that it comes at least so close that the selection sinker 3 is held in the initial position by the magnetic force of the holding magnet 8.

The cam carriage 16 moves along over the needle bed 2 whereby the selection magnet 14 is fixed to the cam carriage 16 in such a way that its pole face is guided past, in non-contact making manner, but close to the narrow face of the selection sinker 3 which is remote from the needle.

Figure 2:
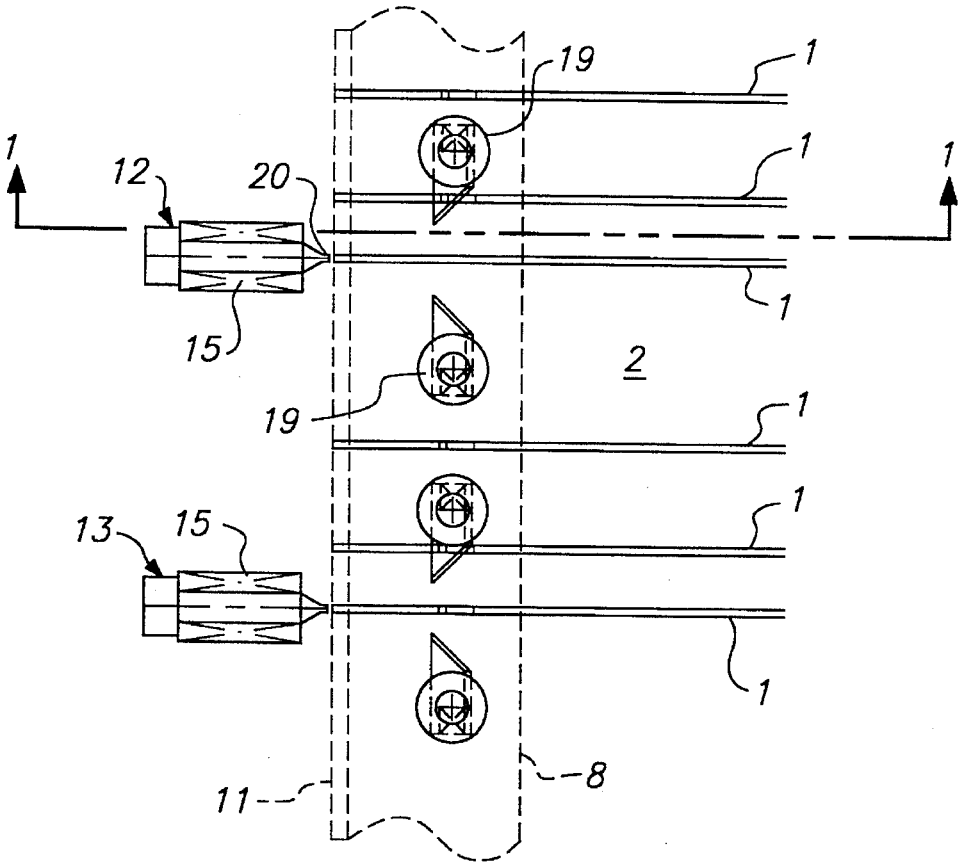
FIG. 2 shows the arrangement illustrated in FIG. 1 in the form of a schematic top view.

In each case, the presser cams 19 are located with respect to the directions of movement of the cam carriage 16 and hence of the control systems 12 and 13, as can best be seen from FIG. 2, at a predetermined distance in front of the pole face 20 above the needle bed so that the selection sinker 3 is placed in its initial position in which it is held by the holding magnet 8, as is apparent from FIG. 1.

Now, should a certain selection sinker 3 and hence a certain needle be selected, the selection magnet 14 is excited due to the application of a current to the excitation coil 15 in such a way that there appears on the pole face 20 a magnetic flux which produces a magnetic flux in it via the air gap between the pole face 20 and the rear end of the selection sinker 3, which magnetic flux is opposed to the magnetic flux produced by the holding magnet 8 and thus neutralises it, or, at least weakens it. Due to this, the selection sinker 3 including the holding part 6 no longer adheres to the short leg of the L-shaped yoke web 10 so that the selection sinker 3 is pressed upwardly due to the spring force of its spring part 7 and its sinker control butt 5 is engaged by the cams 18, and, in known manner, it is driven-out or drawn-out for the displacement of the needle.

On the other hand, should a selection sinker 3 not be selected, then too, current is not applied to the selection magnet 14 and hence it is not excited so that the selection sinker 3 including its holding part 6 continues in this case to be held magnetically on the front face of the short leg 11 of the L-shaped yoke web 10.

The invention has been described in terms of a preferred embodiment. For the skilled person, it is however possible to have innumerable variations and modifications without thereby departing from the concept of the invention. For example, more than two control systems could also be provided on a cam carriage.

I claim:

1. A textile machine including controllable working elements arranged across a length of the textile machine and a working element selection device, each of said working elements having an external surface, wherein the working elements are held in an initial position by a holding magnet and are selectively released from the initial position by at least one electromagnetic control system, the improvement comprising the holding magnet being rigidly fixed to and extending across the length of the textile machine adjacent to the external surfaces of the working elements and the control system being movable in non-contact making manner over the length of the textile machine adjacent to the external surfaces of the working elements.

2. A textile machine as in claim 1, wherein each working element comprises a ferromagnetic material.

3. A textile machine as in claim 1, wherein the control system comprises at least one controllable selection magnet which applies a controllable magnetic flux to at least one working element and wherein the selection magnet selectively produces a first magnetic flux which is directed oppositely to a second magnetic flux produced by the holding magnet.

4. A textile machine as in claim 1, wherein each working element comprises a spring part for biasing purposes.

5. A textile machine as in claim 4, wherein the spring part is formed in one piece with the working element.

6. A textile machine as in claim 4, wherein the magnitude of the second magnetic flux of the holding magnet is selected such that it holds the working elements in the initial position against the spring force of the spring part.

7. A textile machine as in claim 3, wherein, when selecting a working element, the selection magnet produces the first magnetic flux so as to correspond substantially in strength to the second magnetic flux produced by the holding magnet but which is directed oppositely thereto.

8. A textile machine as in claim 3, wherein the selection magnet is an electromagnet including at least one excitation coil through which a controlled current flows.

9. A textile machine as in claim 3, wherein the selection magnet includes pole faces having shape and dimensions which substantially correspond to those of the external surfaces of the working elements which face the control system.

10. A textile machine as in claim 1, wherein the control system comprises at least two control regions which are spaced apart from one another in the direction of movement.

11. A textile machine as in claim 1, wherein the textile machine is a circular or flat bed knitting machine.

12. A textile machine as in claim 1, wherein the working elements are needles.

13. A textile machine as in claim 1, wherein the working elements are sinkers.

14. A textile machine as in claim 1, wherein the working elements are placed in the initial position by at least one control element.

15. A textile machine as in claim 14, wherein the control element is a presser cam.

16. A textile machine as in claim 1, wherein a pole face of the selection magnet is guided in non-contact making manner past end faces of the working elements remote from the needles.

17. A textile machine as in claim 1, wherein the holding magnet is arranged below a needle bed.

18. A textile machine as in claim 17, wherein the holding magnet extends over the full length of the needle bed in the form of a magnetic strip.

19. A textile machine as in claim 1, wherein a yoke strip having a yoke pole face which is a holding surface for a corresponding holding part of the working element, is connected to the holding magnet.

20. A textile machine as in claim 19, wherein the yoke strip is an L-shaped web consisting of ferromagnetic material which extends over the full length of the holding magnet.

21. A textile machine, comprising:

a working portion having a plurality of controllable working elements arranged across a length of the working portion, each of said working elements having an external surface;

a holding magnet rigidly affixed across the length of the working portion adjacent to the external surfaces of the working element for holding the working elements in an initial position; and at least one electromagnetic control system for selectively releasing the working elements from the initial position, said control system being movable in a non-contact making manner adjacent to the external surfaces of the working elements.

* * * * *